US007465039B2

(12) United States Patent
Enomoto et al.

(10) Patent No.: US 7,465,039 B2
(45) Date of Patent: Dec. 16, 2008

(54) LIQUID EJECTION HEAD AND IMAGE FORMING APPARATUS

(75) Inventors: Katsumi Enomoto, Kanagawa (JP); Yasuhiko Maeda, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 489 days.

(21) Appl. No.: 11/356,038

(22) Filed: Feb. 17, 2006

(65) Prior Publication Data

US 2006/0187271 A1 Aug. 24, 2006

(30) Foreign Application Priority Data

Feb. 21, 2005 (JP) ..... 2005-044319

(51) Int. Cl.
*B41J 2/045* (2006.01)
*B41J 2/05* (2006.01)

(52) U.S. Cl. ..... 347/68; 347/71; 347/72; 347/64

(58) Field of Classification Search ..... 347/68, 347/71, 72, 64, 54, 70, 67, 58, 59
See application file for complete search history.

(56) References Cited

U.S. PATENT DOCUMENTS

| | | | | |
|---|---|---|---|---|
| 6,481,834 | B2 | 11/2002 | Takahashi et al. | |
| 2006/0061631 | A1* | 3/2006 | Yokouchi | 347/68 |
| 2006/0066677 | A1* | 3/2006 | Hori | 347/50 |
| 2006/0066688 | A1* | 3/2006 | Sugimoto et al. | 347/68 |
| 2006/0066689 | A1* | 3/2006 | Hori | 347/68 |
| 2006/0077229 | A1* | 4/2006 | Yokouchi | 347/50 |

FOREIGN PATENT DOCUMENTS

| | | | |
|---|---|---|---|
| JP | 9-226114 | A | 9/1997 |

(Continued)

*Primary Examiner*—Stephen D Meier
*Assistant Examiner*—Rene Garcia, Jr.
(74) *Attorney, Agent, or Firm*—Birch, Stewart, Kolasch & Birch, LLP

(57) ABSTRACT

The liquid ejection head comprises: a plurality of ejection ports which eject liquid; a plurality of pressure chambers which are communicated with the ejection ports; a plurality of piezoelectric elements which are arranged to sides of the pressure chambers opposite sides of the pressure chambers where the ejection ports are formed, the piezoelectric elements each having driving electrodes, the piezoelectric elements each deforming the pressure chambers when drive signals are applied through the driving electrodes; a protective member which covers the piezoelectric elements and has a first wiring layer electrically connected to a first external wiring; a common liquid chamber which is arranged on the protective member on the sides of the plurality of pressure chambers opposite the sides of the pressure chambers where the ejection ports are formed, a wall of the common liquid chamber opposite the protective member having a second wiring layer electrically connected to a second external wiring, the common liquid chamber supplying the liquid to the plurality of pressure chambers; and a plurality of wiring members which are electrically connected to the second wiring layer and formed so that at least a part of each of the wiring members extends inside the common liquid chamber in a direction substantially perpendicular to a surface on which the piezoelectric elements are arranged, wherein a part of the driving electrodes of the piezoelectric elements are electrically connected to the first wiring layer, and another part of the driving electrodes of the piezoelectric elements are electrically connected to the second wiring layer through the wiring members.

(Continued)

10 Claims, 6 Drawing Sheets

U.S. PATENT DOCUMENTS

2006/0176344 A1* 8/2006 Mita ..... 347/71

FOREIGN PATENT DOCUMENTS

JP 2001-179973 A 7/2001
JP 2001-353871 A 12/2001
JP 2002-36547 A 2/2002
JP 2002-86724 A 3/2002
JP 2002-264331 A 9/2002

* cited by examiner

LIQUID EJECTION HEAD AND IMAGE FORMING APPARATUS

BACKGROUND OF THE INVENTION

1. Field of the Invention

The present invention relates to a liquid ejection head and an image forming apparatus, and particularly relates to a liquid ejection head in which droplets are ejected from nozzles.

2. Description of the Related Art

There are known image forming apparatuses that employ an inkjet system in which ink droplets are ejected from a plurality of nozzles provided in a print head (liquid ejection head) to form images on a recording medium. Such image forming apparatuses require a high density in the nozzles, high frequency driving, and the ejection of highly viscous ink in order to achieve high quality in the images and to perform high speed printing.

Various configurations for print heads have been proposed (see Japanese Patent Application Publication Nos. 2001-179973, 2001-353871, 9-226114, 2002-36547, 2002-86724, and 2002-264331, for example).

Japanese Patent Application Publication No. 2001-179973 discloses a configuration in which a common ink chamber (ink supply tank) is disposed on the side of the pressure chambers (pressure generating chambers) opposite the side on which the nozzles are formed. In this configuration, an adhesive layer, a flow channel forming substrate, a cavity forming substrate including a cavity as a pressure chamber, and a diaphragm are layered in this order from the ink ejecting side. Piezoelectric elements (piezoelectric vibrating elements) are disposed on the side of the diaphragm opposite the side facing the cavity forming substrate. A common liquid chamber configured from wall designed to enclose the piezoelectric elements is then disposed on the sides of the piezoelectric elements of the diaphragm. In this configuration, ink is supplied to the pressure chambers from the common liquid chamber through tiny supply holes formed in the diaphragm, ink supply holes formed in the cavity forming substrate, and communicating holes formed in the flow channel forming substrate.

However, in the configuration disclosed in Japanese Patent Application Publication No. 2001-179973, there are problems with poor refilling properties, because the ink held in the common liquid chamber is supplied to the pressure chambers from above the pressure chambers (the side of the pressure chambers opposite the side on which the nozzles are formed) by means of the communicating holes positions below the pressure chambers (the side of the pressure chambers on which the nozzles are formed). This configuration also has a flexible cable as an external wire connected to one end of the diaphragm, wherein the drive electrodes of the piezoelectric elements are arrayed along the surface of the diaphragm. Therefore, these wiring spaces might be insufficient when the piezoelectric elements are arranged at a high density.

Japanese Patent Application Publication No. 2001-353871 discloses a configuration in which a common liquid chamber (reservoir) is disposed on the side of the pressure chambers (pressure generating chambers) opposite the side on which the nozzles are formed. In this configuration, piezoelectric elements (piezoelectric vibrating elements) are disposed on a diaphragm (flow channel sealing plate) constituting one wall of the pressure chambers, and the common liquid chamber is disposed at a position corresponding to a portion on the diaphragm other than the areas where the pressure chambers are aligned. The portion of the diaphragm corresponding to the common liquid chamber opening is a thin portion, and is designed to absorb fluctuations in ink pressure.

However, the configuration disclosed in Japanese Patent Application Publication No. 2001-353871 is designed with the common liquid chamber disposed at a position on the diaphragm corresponding to the portion other than the area where the pressure chambers are aligned. Specifically, the configuration is designed so that the common liquid chamber cannot be disposed directly above the pressure chambers and ink cannot be directly supplied to the pressure chambers, which is not suitable for a high density arrangement of the pressure chambers. Moreover, the wiring configuration for electrically connecting the drive electrodes of the piezoelectric elements to the external wiring is not taken into account. Therefore, the wiring spaces for electrically connecting to the external wiring might be insufficient when the piezoelectric elements are arranged at a high density.

Japanese Patent Application Publication No. 9-226114 discloses a configuration in which a common liquid chamber (reservoir) is disposed on the side of the pressure chambers opposite the side on which the nozzles are formed. In this configuration, piezoelectric elements are disposed on a diaphragm constituting one wall of the pressure chambers, the common liquid chamber is formed on the side of the diaphragm with the piezoelectric elements, and the ink chambers are communicated with the common liquid chamber through supply holes formed in the diaphragm.

However, in the configuration disclosed in Japanese Patent Application Publication No. 9-226114, the wiring configuration for electrically connecting the drive electrodes of the piezoelectric elements to the external wiring is not taken into account. Therefore, the wiring spaces for electrically connecting to the external wiring might be insufficient when the piezoelectric elements are arranged at a high density.

Japanese Patent Application Publication No. 2002-36547 discloses a configuration in which a common liquid chamber (common ink chamber) is disposed on the same side of the pressure chambers (pressure generating chambers) on which the nozzles are formed. In this configuration, piezoelectric elements are disposed on a diaphragm (elastic film) constituting the top walls of the pressure chambers, and a protective cover (bonding substrate) formed from glass covers the piezoelectric elements. The common liquid chamber is formed on the ink ejecting side of the nozzle plate on which the nozzles are formed (the side opposite the pressure chambers), and the common liquid chamber is communicated with the pressure chambers through ink supply holes, each of which is formed at a position in the nozzle plate corresponding to an end of each of the pressure chambers.

However, the configuration disclosed in Japanese Patent Application Publication No. 2002-36547 is designed with the drive electrodes of the piezoelectric elements connected to the external wiring through a lead electrode running along the diaphragm. Since the piezoelectric elements are arranged on the diaphragm, these wiring spaces might be insufficient when the piezoelectric elements are arranged at a high density. This configuration also has problems with poor properties in terms of refilling the pressure chambers with ink from the common liquid chamber, because the common liquid chamber is provided to the ink ejecting side of the nozzle plate.

Japanese Patent Application Publication No. 2002-86724 discloses a configuration in which a common liquid chamber (reservoir) is disposed on the side of the pressure chambers (pressure generating chambers) opposite the side on which the nozzles are formed. In this configuration, piezoelectric elements are disposed at positions that face the pressure chambers across a diaphragm (elastic film) constituting the top walls of the pressure chambers, and a protective cover (sealing member) formed from silicon divides and seals the piezoelectric elements with dividing walls. The common liquid chamber is disposed on the piezoelectric element side of the pressure chambers at a different area from where the piezoelectric elements are arrayed.

However, in the configuration disclosed in Japanese Patent Application Publication No. 2002-86724, the wiring configuration for electrically connecting the drive electrodes of the piezoelectric elements to the external wiring is not taken into account. Therefore, the wiring spaces for electrically connecting to the external wiring might be insufficient when the piezoelectric elements are arranged at a high density. Moreover, the configuration is designed with the pressure chambers on the diaphragm aligned in one row, and the common liquid chamber is provided so as to be aligned along this row of pressure chambers, which is not suitable for a high density arrangement of the pressure chambers.

Japanese Patent Application Publication No. 2002-264331 discloses a configuration in which a common liquid chamber (reservoir) is disposed on the pressure chambers (pressure generating chambers) on the same side on which the nozzles are formed. In this configuration, the walls of the pressure chambers on the nozzle side are configured from a diaphragm (elastic film), and the piezoelectric elements are disposed at positions that face the pressure chambers across the diaphragm. The common liquid chamber is formed on the ink ejecting side of a sealing plate on which the nozzles are formed (the side opposite the pressure chambers) at a position corresponding to the end of the sealing plate. The pressure chambers are formed by the half-etching of silicon, and are provided with atmosphere communicating holes (through-holes) embedded in the bottom faces.

However, the configuration disclosed in Japanese Patent Application Publication No. 2002-264331 is designed with the drive electrodes of the piezoelectric elements connected to the external wiring through a lead electrode running along the surface of the diaphragm, and since the piezoelectric elements are arranged on the diaphragm, these wiring spaces might be insufficient when the piezoelectric elements are arranged at a high density.

SUMMARY OF THE INVENTION

In view of these circumstances, an object of the present invention is to provide a liquid ejection head and image forming apparatus wherein sufficient wiring spaces for electrically connecting the drive electrodes of the piezoelectric elements to the external wiring can be ensured, and high density in the nozzles as well as improvement in the refilling properties can be achieved.

In order to attain the aforementioned object, the present invention is directed to a liquid ejection head, comprising: a plurality of ejection ports which eject liquid; a plurality of pressure chambers which are communicated with the ejection ports; a plurality of piezoelectric elements which are arranged to sides of the pressure chambers opposite sides of the pressure chambers where the ejection ports are formed, the piezoelectric elements each having driving electrodes, the piezoelectric elements each deforming the pressure chambers when drive signals are applied through the driving electrodes; a protective member which covers the piezoelectric elements and has a first wiring layer electrically connected to a first external wiring; a common liquid chamber which is arranged on the protective member on the sides of the plurality of pressure chambers opposite the sides of the pressure chambers where the ejection ports are formed, a wall of the common liquid chamber opposite the protective member having a second wiring layer electrically connected to a second external wiring, the common liquid chamber supplying the liquid to the plurality of pressure chambers; and a plurality of wiring members which are electrically connected to the second wiring layer and formed so that at least a part of each of the wiring members extends inside the common liquid chamber in a direction substantially perpendicular to a surface on which the piezoelectric elements are arranged, wherein a part of the driving electrodes of the piezoelectric elements are electrically connected to the first wiring layer, and another part of the driving electrodes of the piezoelectric elements are electrically connected to the second wiring layer through the wiring members.

According to the present invention, the configuration is designed so that each of the driving electrodes of the piezoelectric elements is electrically connected to the first wiring layer of the protective cover, or through the wiring member that extends inside the common liquid chamber to the second wiring layer formed on the top wall of the common liquid chamber, and sufficient wiring spaces for electrically connecting the driving electrodes of the piezoelectric elements to the external wiring can therefore be ensured. The piezoelectric elements can thereby be arranged with a high density, and high density can also be achieved in the ejection ports. Also, refilling properties can be improved and high frequency driving of the ejection ports as well the ejection of highly viscous liquid is made possible, because the common liquid chamber is configured on the side of the pressure chambers opposite the side on which the ejection ports are formed, and the liquid can be supplied directly to the pressure chambers.

The term "top wall of the common liquid chamber" refers to the wall forming the inner surface of the common liquid chamber opposite the inner surface of the common liquid chamber nearby the piezoelectric elements.

Preferably, the protective member is configured by overlapping a multilayer wired green sheet and a green sheet having recesses for covering the piezoelectric elements, in a first aspect. Alternatively, it is also preferable that the protective member is configured by overlapping a wiring layer and an insulating layer on a silicon substrate, and has recesses for covering the piezoelectric elements formed on a side of the silicon substrate opposite the wiring layer, in a second aspect. Alternatively, it is also preferable that the protective member is configured by overlapping an insulating layer and a wiring layer formed by a selective droplet ejection device on a rigid substrate, and has recesses for covering the piezoelectric elements formed on a side of the rigid substrate opposite the wiring layer, in a third aspect.

According to any of the first to third aspects of the protective member, it is possible to form a thin protective member, and the properties of refilling the pressure chambers with the liquid from the common liquid chamber are improved. The protective member also has a structure which covers the piezoelectric elements, and the manufacturing steps can be simplified. In particular, an advantage is that the structure in the first aspect can be obtained by joint baking, and delamination can be prevented. In the second aspect, forming this structure by a semiconductor process is made possible, and high density can be achieved. In the third aspect, an even thinner layer is made possible.

Preferably, a thickness from the side of the pressure chamber on the piezoelectric element to the side of the protective member on the common liquid chamber is not less than 100 μm and not more than 200 μm. According to the present invention, the properties of refilling the pressure chambers with the liquid from the common liquid chamber are improved, and ejection of highly viscous liquid as well as high frequency driving of the ejection ports are made possible.

Preferably, the liquid ejection head further comprises: a plurality of pressure sensors which detect pressure fluctuations in the pressure chambers, wherein all the driving electrodes of the piezoelectric elements are electrically connected to one of the first wiring layer and the second wiring layer, and all the detecting electrodes of the pressure sensors are electrically connected to the other of the first wiring layer and the second wiring layer. According to the present invention, high density wiring can be mounted and mutual noise interference can be prevented as a result of electrically connecting the driving electrodes of the piezoelectric elements and the detecting electrodes of the pressure sensors to the external wirings through different wiring layers.

Preferably, the wiring members are formed so as to extend from the piezoelectric elements or the vicinity of the piezoelectric elements. According to the present invention, the ejection ports can be made denser.

Preferably, the ejection ports are two-dimensionally arrayed; and the wiring members are two-dimensionally arrayed with respect to the surface on which the piezoelectric elements are arranged. According to the present invention, the ejection ports can be made denser and crosstalk can be effectively prevented.

In order to attain the aforementioned object, the present invention is also directed to an image forming apparatus, comprising the above-described liquid ejection head.

According to the present invention, the configuration is designed so that each of the driving electrodes of the plurality of piezoelectric elements is electrically connected to one of the first wiring layer formed on the protective cover and the second wiring layer formed on the top wall of the common liquid chamber through the wiring members that extend upward inside the common liquid chamber, and sufficient wiring spaces for electrically connecting the driving electrodes of the piezoelectric elements to the external wiring can therefore be ensured. The piezoelectric elements can thereby be arranged with a high density, and high density can also be achieved in the ejection ports. Also, refilling properties can be improved and high frequency driving of the ejection ports as well the ejection of highly viscous liquid is made possible, because the common liquid chamber is configured on the side of the pressure chambers opposite the side on which the ejection ports are formed, and liquid can be supplied directly to the pressure chambers.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Composition of Inkjet Recording Apparatus

Figure 1:
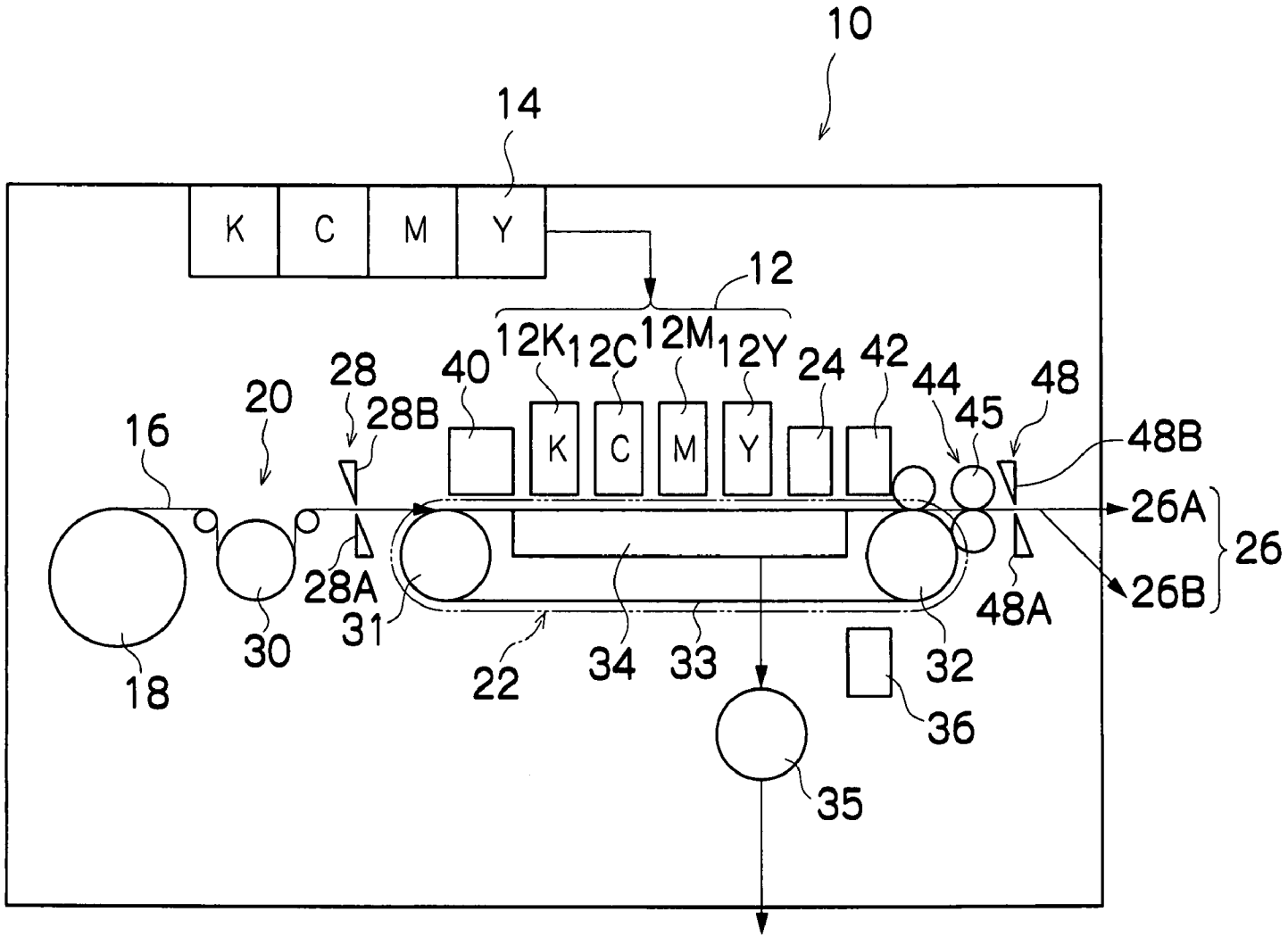
FIG. 1 is a general structural view showing the schematics of an inkjet recording apparatus as an image forming apparatus according to a first embodiment of the present invention.

FIG. 1 is a diagram of the general composition showing an outline of an inkjet recording apparatus as an image forming apparatus according to a first embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus configuration that uses rolled paper, a cutter 28 is provided for cutting as shown in FIG. 1, and the rolled paper is cut to the desired size by this cutter 28. The cutter 28 is configured from a fixed blade 28A with a length equal to or greater than the width of the conveyed path of the recording paper 16, and a round blade 28B that moves along the fixed blade 28A, wherein the fixed blade 28A is provided to the reverse side of printing, and the round blade 28B is disposed on the printed side with the conveyed path in between. When cut paper is used, the cutter 28 is not needed.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction).

Each of the print heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (left-hand side in FIG. 1), along the conveyance direction of the recording paper 16 (the paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction that is perpendicular to the paper conveyance direction (main scanning direction).

The terms "main scanning direction" and "sub-scanning direction" are used with the following meanings. When the nozzles are driven with a full-line head that has a nozzle row corresponding to the entire width of the recording paper, (1) all the nozzles are driven simultaneously, (2) the nozzles are driven sequentially from one side to the other, (3) the nozzles are grouped into blocks, and the nozzles are driven sequentially from one side to the other in each of the blocks, or another drive mode is used. Driving the nozzles so that a single line (a line of a single row of dots or a line composed of a plurality of dot rows) is printed in the width direction of the paper (the direction orthogonal to the direction in which recording paper is conveyed) is defined as main scanning. The direction of a single line (longitudinal direction of a belt-shaped region) recorded by main scanning is referred to as the main scanning direction.

Repeating the printing of a single line (a line of a single row of dots or a line composed of a plurality of dot rows) formed by main scanning by moving the full-line head and the recording paper relatively to each other is defined as sub-scanning. The direction in which sub-scanning is performed is referred to as the sub-scanning direction. Therefore, the direction in which recording paper is conveyed is the sub-scanning direction, and the direction orthogonal thereto is the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photodetector elements having a width that is greater than the ink-droplet ejection width (image recording width) of the print heads 12K, 12C, 12M, and 12Y. This line sensor has a color separation line CCD sensor including a red (R) sensor row composed of linearly arranged photodetector elements (pixels) provided with an R filter, a green (G) sensor row with a G filter, and a blue (B) sensor row with a B filter. Instead of a line sensor, it is possible to use an area sensor composed of photodetector elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (the second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Structure of the Head

Next, the structure of a print head 50 will be described. The print heads 12K, 12C, 12M and 12Y of the respective ink colors have the same structure, and a reference numeral 50 is hereinafter designated to any of the print heads.

Figure 2:
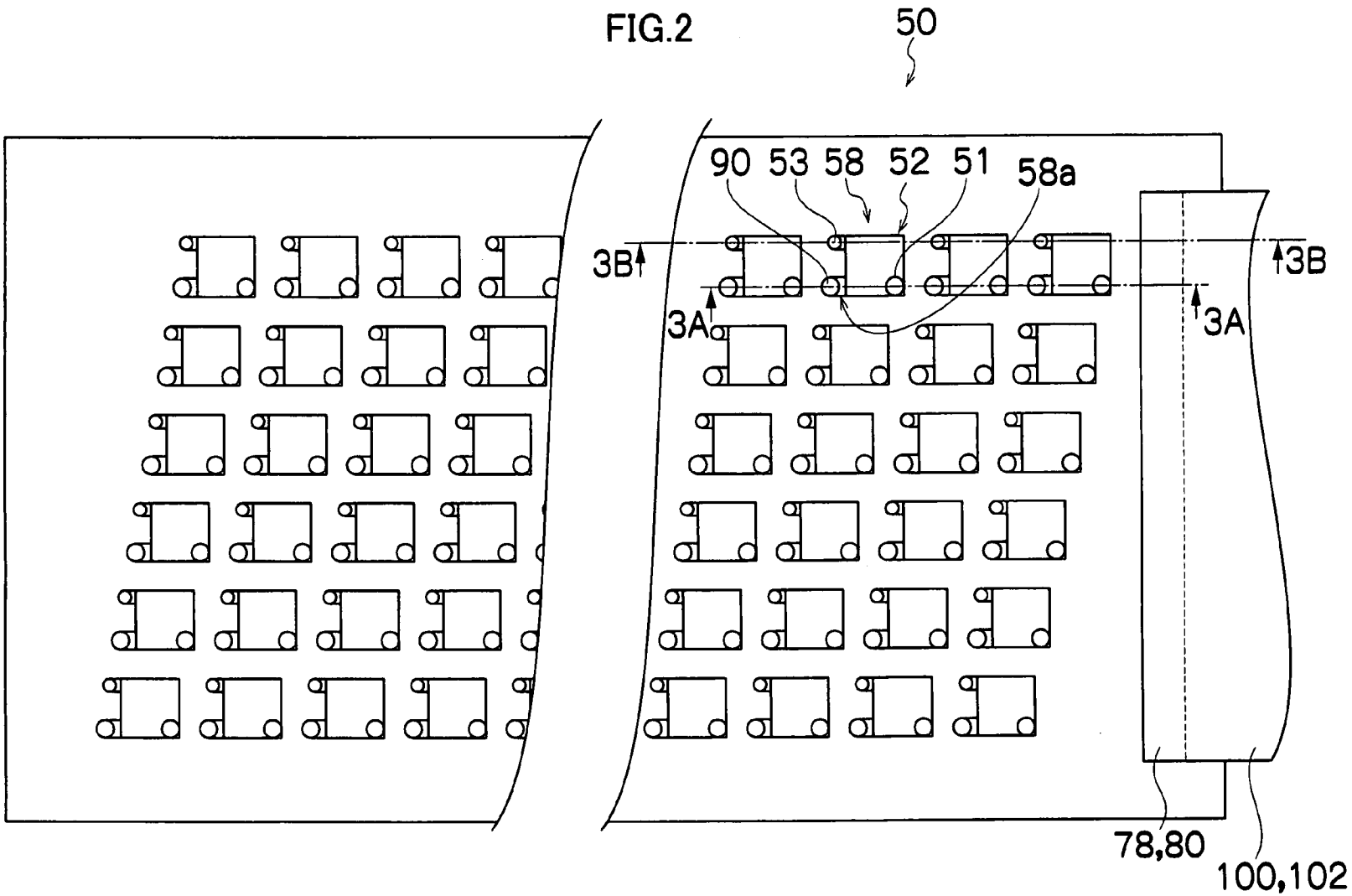
FIG. 2 is a perspective plan view depicting the schematic configuration of a print head.

FIG. 2 is a perspective plan view showing the schematic configuration of the print head 50. In the print head 50 of the present embodiment, nozzles 51 for ejecting ink droplets are formed in a staggered matrix (two-dimensional) pattern, ensuring high density in the nozzles 51, as shown in FIG. 2.

In the print head 50, pressure chambers 52 with a substantially rectangular shape in plan view are formed corresponding to the nozzles 51, and piezoelectric elements 58 with substantially the same planar shape as the pressure chambers 52 are formed overlapping the pressure chambers 52. The pressure chambers 52 have ink supply ports 53 for supplying ink to the pressure chambers 52 provided to the outer sides in the top left corners in FIG. 2. The piezoelectric elements 58 have protuberances 58*a* configured integrally with the piezoelectric elements 58 and provided to the bottom left corners in FIG. 2 so as to protrude outward. Also, wiring members 90 for driving the piezoelectric elements 58 are formed at the distal ends of the protuberances 58*a*. The planar shapes and arrangement relationships of the nozzles 51, the pressure chambers 52, the piezoelectric elements 58, the ink supply ports 53, and the wiring members 90 are not limited to those of the present embodiment.

Flexible cables 100 and 102 as external wires are electrically connected through connectors 78 and 80 to the print head 50 at one end in the longitudinal direction (the right end in FIG. 2). The other ends of the flexible cables 100 and 102 are electrically connected to a drive circuit (not shown) for driving the piezoelectric elements 58.

Figure 3A:
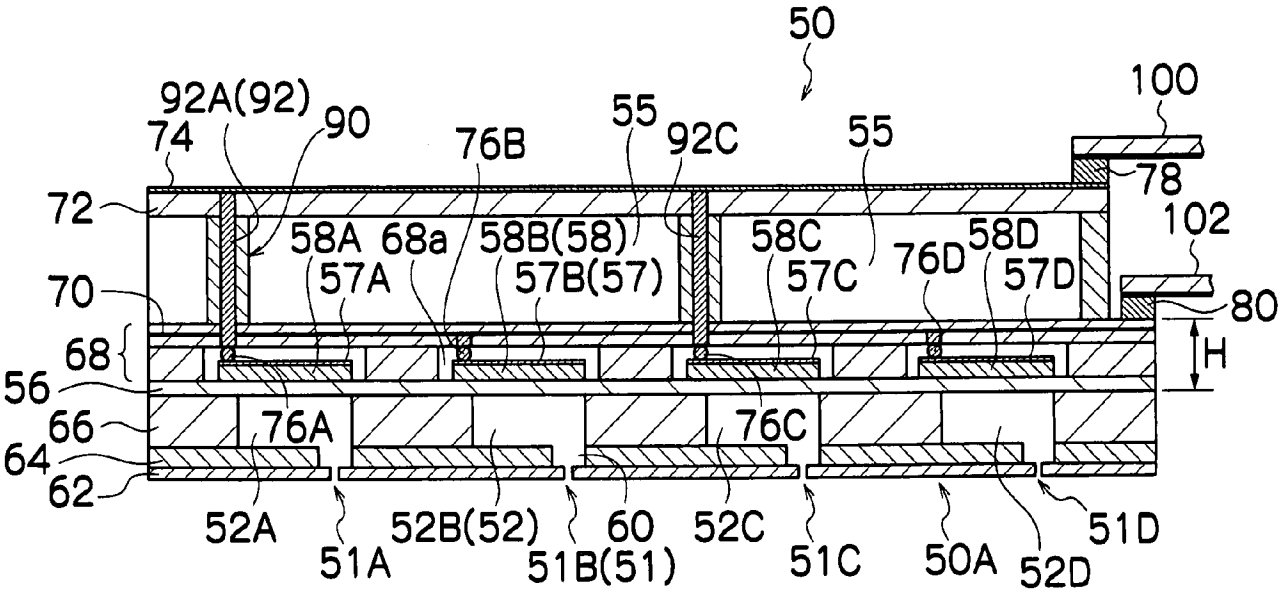
FIG. 3A is a cross-sectional view along the line 3A-3A in FIG. 2.
Figure 3B:
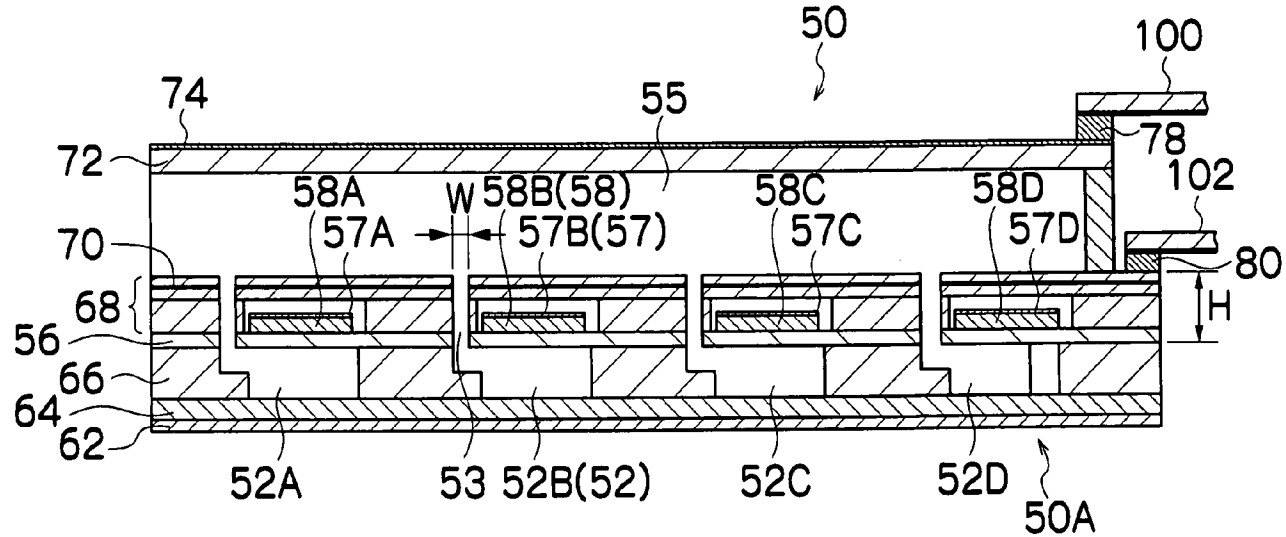
FIG. 3B is a cross-sectional view along the line 3B-3B in FIG. 2.

FIGS. 3A and 3B are cross-sectional side views depicting part of the print head 50 shown in FIG. 2. FIG. 3A is a cross-sectional view along the line 3A-3A in FIG. 2, and FIG. 3B is a cross-sectional view along the line 3B-3B in FIG. 2. As shown in FIG. 3A, the print head 50 is configured by stacking the following in order from the side with the ink ejecting surface (nozzle surface) 50A: a nozzle plate 62 on which the nozzles 51 are formed, a nozzle flow channel plate 64 in which nozzle flow channels 60 are formed, a pressure chamber plate 66 constituting the side walls of the pressure chambers 52, and a diaphragm 56 constituting the top walls of the pressure chambers 52. The nozzles 51 are communicated with the pressure chambers 52 through the nozzle flow channels 60. The piezoelectric elements 58 having individual electrodes 57 (driving electrodes) are arranged on the diaphragm 56 so as to face the pressure chambers 52 across the diaphragm 56. An electrically conductive member (not shown) is formed on the surface of the diaphragm 56 and made to function as the common electrode of the piezoelectric elements 58.

A protective cover 68 (protective member) having recesses 68*a* formed around the piezoelectric elements 58 is provided on the diaphragm 56. The configuration and other features of the protective cover 68 will be described later. The space formed on the protective cover 68 is a common liquid chamber 55 for holding the ink supplied from the ink tank (not shown), which is the ink supply source. More specifically, the bottom wall of the common liquid chamber 55 is configured by the protective cover 68. The top wall of the common liquid chamber 55 is configured by a wiring substrate 72. The common liquid chamber 55 is communicated with the pressure chambers 52 through the ink supply ports 53 provided for the pressure chambers 52, as shown in FIG. 3B.

Pillar-shaped wiring members 90 configured so as to connect the protective cover 68 with the wiring substrate 72 are provided in the interior of the common liquid chamber 55, as shown in FIG. 3A. The wiring members 90 have electrodes 92 (92A, 92C) in the interior, and are configured to extend substantially vertically in relation to the diaphragm 56, on which the piezoelectric elements 58 are disposed. Ends (the lower ends in FIG. 3A) of the electrodes 92A and 92C extend through the protective cover 68 and are electrically connected to the individual electrodes 57A and 57C of the piezoelectric elements 58A and 58C through solder balls 76A and 76C, respectively. The other ends (the upper ends in FIG. 3A) of the electrodes 92 (92A, 92C) are electrically connected to a wiring layer 74 (the second wiring layer) of the wiring substrate 72, which is patterned for the piezoelectric elements. The flexible cable 100 (the second external wiring) is electrically connected to one end of the wiring substrate 72 through the connector 78, and the flexible cable 100 is electrically connected to the wiring layer 74.

The protective cover 68 in the present embodiment is formed by overlapping and jointly baking a multilayered wired green sheet having a thickness of several tens micrometers and a green sheet having cavities. The interior of the protective cover 68 formed in this manner has a wiring layer 70 (the first wiring layer) patterned for the piezoelectric elements. The individual electrodes 57B and 57D of the piezoelectric elements 58B and 58D are electrically connected to the wiring layer 70 through solder balls 76B and 76D, respectively. The flexible cable 102 (the first external wiring) is electrically connected to one end of the protective cover 68 through the connector 80, and the flexible cable 102 is electrically connected to the wiring layer 70. The elements for establishing conduction with the wiring layers are not limited to solder balls.

It is preferable that the thickness H of the protective cover 68 and the diaphragm 56 (see FIGS. 3A and 3B) is small. The refilling properties are further improved by reducing the flow channel resistance against the ink supplied to the pressure chambers 52 from the common liquid chamber 55 through the ink supply ports 53. In particular, when the nozzles 51 are driven at a high frequency of about 40 kHz, the thickness H of the protective cover 68 and the diaphragm 56 must be about 200 μm or less, assuming that the diameter W of the ink supply ports 53 is about 80 μm. Therefore, taking the thickness of the diaphragm 56 into account, the thickness H of the protective cover 68 and the diaphragm 56 is preferably not less than 100 μm and not more than 200 μm.

Next, the operation of the print head 50 will be described with reference to FIGS. 3A and 3B. First, the ink held in the common liquid chamber 55 is distributed and supplied to the pressure chambers 52 through the ink supply ports 53. When a drive signal for the piezoelectric element 58A (or 58C) is applied through the flexible cable 100, which is electrically connected to the drive circuit (not shown), to the individual electrode 57A (or 57C) of the piezoelectric element 58A (or 58C) through the wiring layer 74 of the wiring substrate 72 and the electrode 92A (or 92C), the portion of the diaphragm 56 corresponding to the pressure chamber 52A (or 52C) deforms due to the displacement of the piezoelectric element 58A (or 58C), and the ink in the pressure chamber 52A (or 52C) is pressurized and ejected as a droplet from the nozzle 51A (or 51C).

When a drive signal for the piezoelectric element 58B (or 58D) is applied through the flexible cable 102, which is electrically connected to the drive circuit (not shown), to the individual electrode 57B (or 57D) of the piezoelectric element 58B (or 58D) through the wiring layer 70 of the protective cover 68, the portion of the diaphragm 56 corresponding to the pressure chamber 52B (or 52D) deforms due to the displacement of the piezoelectric element 58B (or 58D), and the ink in the pressure chamber 52B (or 52D) is pressurized and ejected as a droplet from the nozzle 51B (or 51D).

When ink droplets are ejected from the nozzles 51 (51A-51D) in this manner, new ink is supplied from the common liquid chamber 55 to the pressure chambers 52 (52A-52D) through the ink supply ports 53, and the next cycle of ink ejection is performed.

In the present embodiment, the configuration is designed so that the individual electrodes 57 (driving electrodes) of the piezoelectric elements 58 are electrically connected to the wiring layer 70 (the first wiring layer) of the protective cover 68 or the wiring layer 74 (the second wiring layer) of the wiring substrate 72, through the electrodes 92 of the wiring members 90 that extend upward inside the common liquid chamber 55, and sufficient wiring spaces for electrically connecting the individual electrodes 57 of the piezoelectric elements 58 to the external wiring can therefore be ensured. Hence, the piezoelectric elements 58 can be arranged with a high density, and high density can also be achieved in the nozzles 51. Also, refilling properties can be improved and high frequency driving of the nozzles 51 as well the ejection of highly viscous ink is made possible, because the common liquid chamber 55 is configured on the side opposite the side on which the pressure chambers 52 are formed, and ink can be supplied directly to the pressure chambers 52.

Also, in the present embodiment, the protective cover 68 is formed by overlapping and jointly baking a plurality of green sheets, which has the advantages of eliminating peeling between layers. The properties of refilling the pressure chambers 52 with ink from the common liquid chamber 55 can also be further improved by the use of the thinner protective cover 68.

In the above-described embodiment, the individual electrodes 57 of the piezoelectric elements 58 are electrically connected to the flexible cables 100 and 102 as external wiring through the wiring layers 70 and 74; however, the configuration is not limited thereto, and may be designed with other electrodes electrically connected to the external wiring through the wiring layers 70 and 74. Also, in the above-described embodiment, each of the protective cover 68 and the wiring layers 70 and 74 of the wiring substrate 72 has a single layer; however, they are not limited thereto and may have two or more layers.

Second Embodiment

Figure 4:
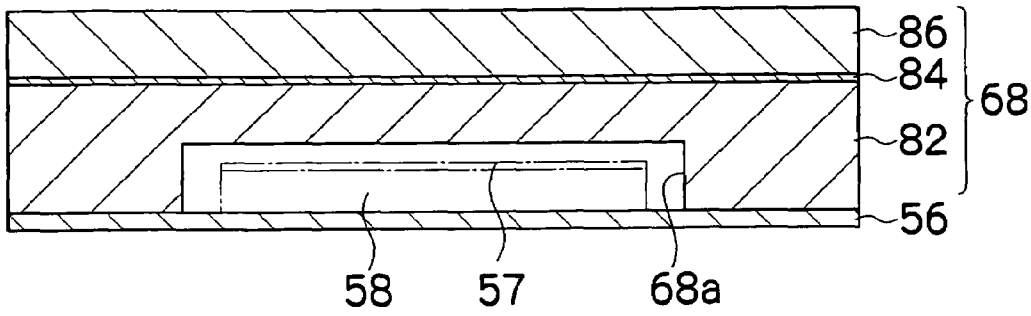
FIG. 4 is a cross-sectional side view depicting part of a protective cover, a diaphragm, and a piezoelectric element in a print head in a second embodiment.

Next, the second embodiment of the present invention will be described. FIG. 4 is a cross-sectional side view showing part of the protective cover 68, the diaphragm 56, and the piezoelectric element 58 of the print head 50 in the second embodiment. As shown in FIG. 4, the protective cover 68 in the present embodiment is configured from three layers, including, from the diaphragm 56 side, a silicon substrate 82, a high density wiring layer 84, and an insulating layer 86. This protective cover 68 is configured by forming the high density wiring layer 84 patterned at a high density on the surface of the silicon substrate 82 having a thickness of about 100 μm, covering the surface of the high density wiring layer 84 with the insulating layer 86 having a thickness of about 50 μm, and forming the recesses 68*a* having a depth of about 50 μm in the surface of the silicon substrate 82 by anisotropic etching. The piezoelectric elements 58 provided on top of the diaphragm 56 are disposed in the recesses 68*a*. The present embodiment exhibits the same effects as the first embodiment, and is designed so that sufficient wiring spaces for electrically connecting the individual electrodes 57 (driving electrodes) of the piezoelectric elements 58 to the external wiring can be ensured.

Third Embodiment

Figure 5:
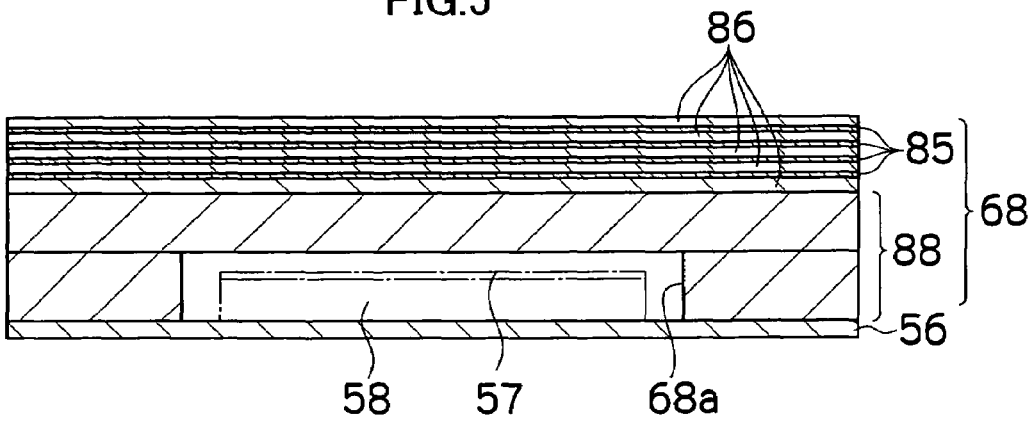
FIG. 5 is a cross-sectional side view depicting part of a protective cover, a diaphragm, and a piezoelectric element in a print head in a third embodiment.

Next, the third embodiment of the present invention will be described. FIG. 5 is a cross-sectional side view showing part of the protective cover 68, the diaphragm 56, and the piezoelectric element 58 of the print head 50 in the third embodiment. As shown in FIG. 5, the protective cover 68 in the present embodiment is created by alternately drawing and layering insulating layers 86 and wiring layers 85 having a thickness of several micrometers on the surface of a rigid substrate 88 with an inkjet (selective droplet ejecting device), and forming the recesses 68*a* in the other surface of the rigid substrate 88 around the piezoelectric elements 58 on top of the diaphragm 56. The rigid substrate 88 is preferably made of insulating material. The present embodiment exhibits the same effects as the first embodiment, and is designed so that sufficient wiring spaces for electrically connecting the individual electrodes 57 (driving electrodes) of the piezoelectric elements 58 to the external wiring can be ensured.

Fourth Embodiment

Figure 6:
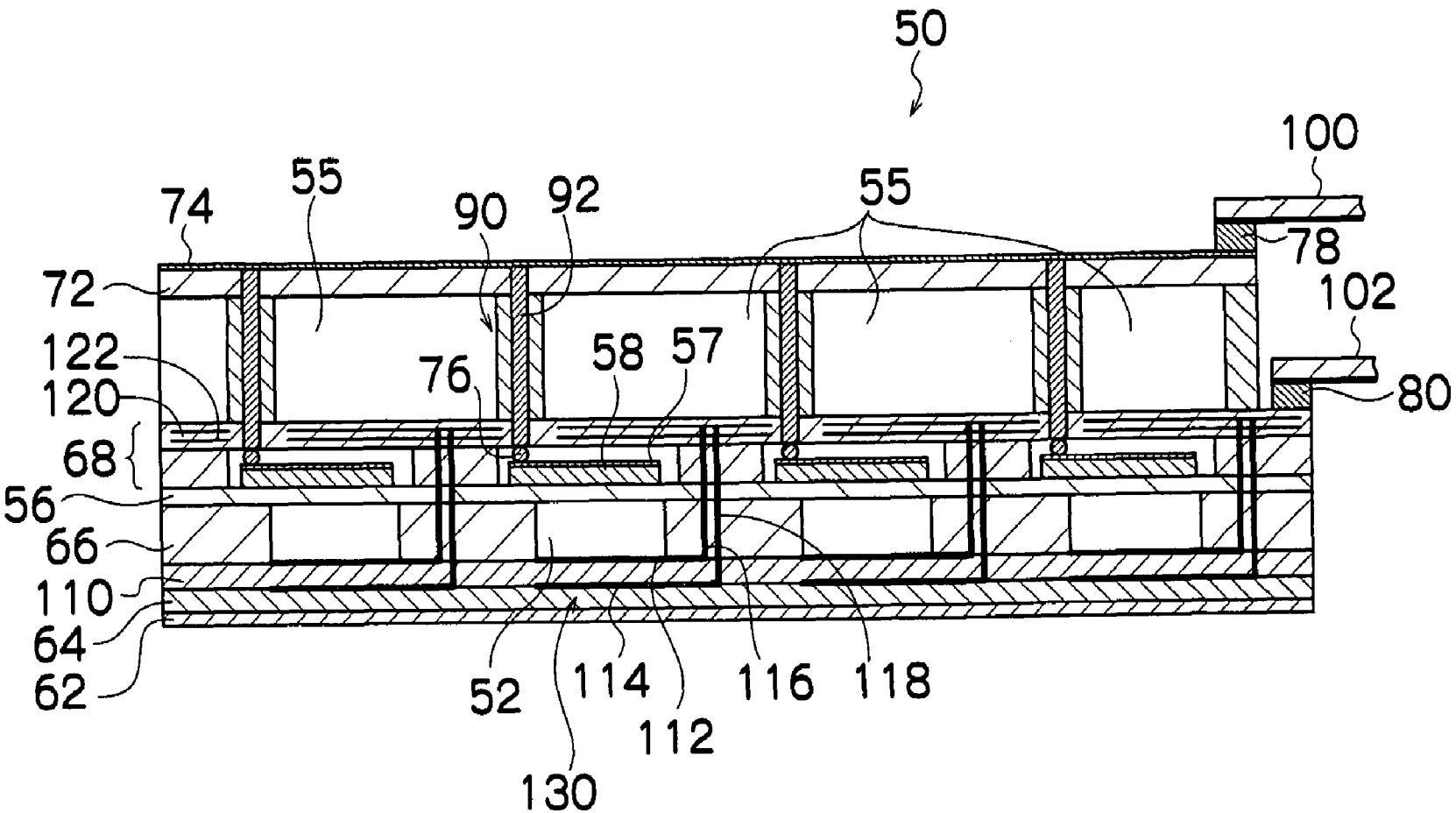
FIG. 6 is a cross-sectional side view of a print head in a fourth embodiment.

Next, the fourth embodiment of the present invention will be described. FIG. 6 is a cross-sectional side view of the print head 50 in the fourth embodiment. The print head 50 in the present embodiment includes pressure sensors 130 for detecting pressure fluctuations in the pressure chambers 52, as shown in FIG. 6. A sensor layer 110 configured from polyvinylidenfluoride (PVDF) is disposed between the nozzle flow channel plate 64 and the pressure chamber plate 66, and sensor electrodes 112 and 114 are formed to face each other across the sensor layer 110 on the portions of the sensor layer 110 that correspond to the pressure chambers 52. The portions of the sensor layer 110 having the sensor electrodes 112 and 114 on both sides serve as the pressure sensors 130.

The sensor electrodes 112 and 114 are electrically connected to two wiring layers 120 and 122 (the first wiring layers) of the protective cover 68 through lead electrodes 116 and 118 arranged in the vertical direction in FIG. 6. The flexible cable 102 (the first external wiring) is electrically connected to the wiring layers 120 and 122 through the connector 80 formed on the end of the protective cover 68. The other end of the flexible cable 102 is electrically connected to a pressure detecting circuit (not shown) for detecting pressure fluctuations in the pressure chambers 52. Thus, the sensor electrodes 112 and 114 are electrically connected to the flexible cable 102.

The individual electrodes 57 (driving electrodes) of the piezoelectric elements 58 are electrically connected to the wiring layer 74 (the second wiring layer) of the wiring substrate 72 through the electrodes 92 of the wiring member 90, similar to the piezoelectric elements 58A and 58C (see FIG. 3A) in the first embodiment. The wiring layer 74 of the wiring substrate 72 is electrically connected to the flexible cable 100 (the second external wiring) through the connector 78. Thus, the individual electrodes 57 of the piezoelectric elements 58 are electrically connected to the flexible cable 100.

Figure 7:
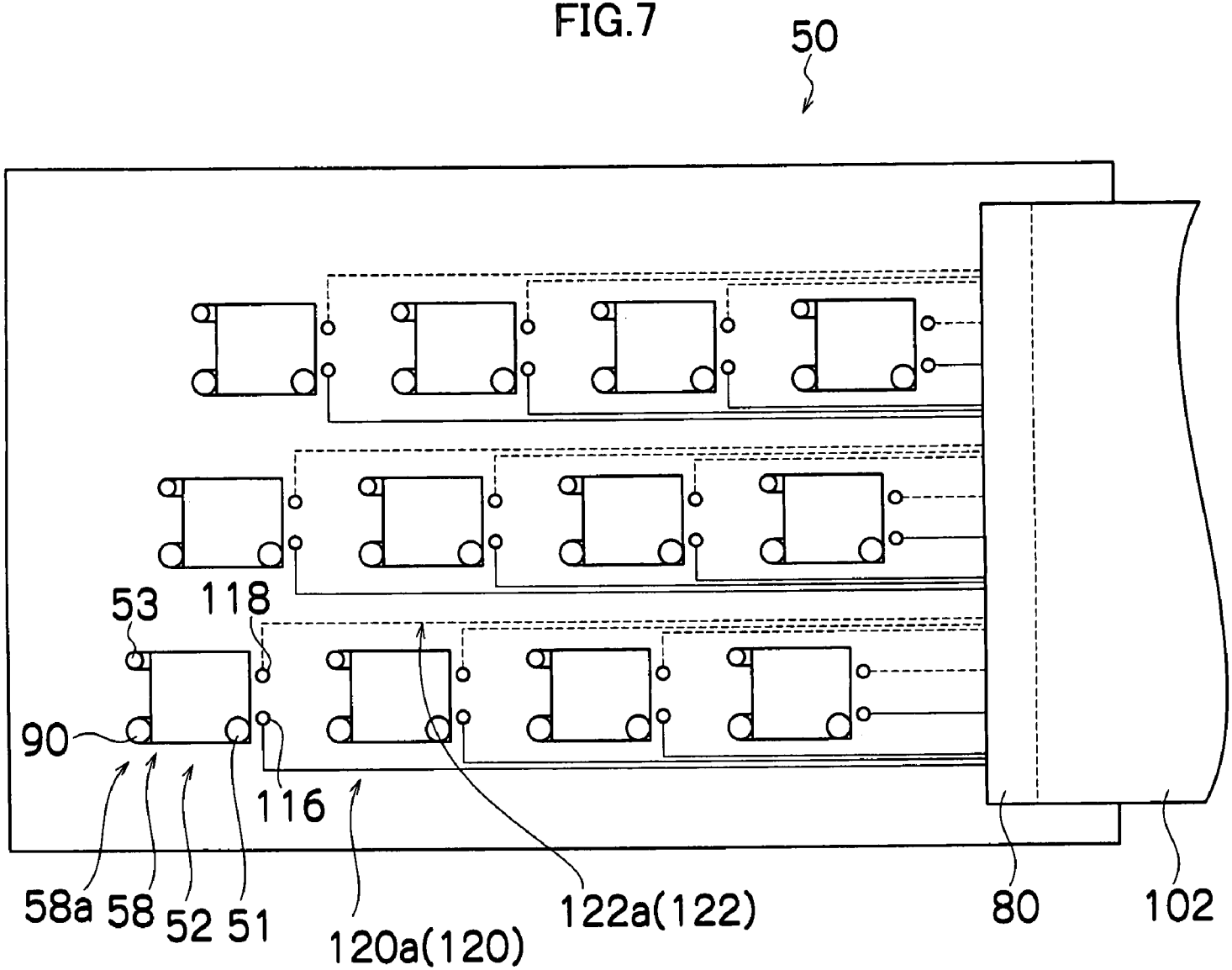
FIG. 7 is a transparent plan view of the print head shown in FIG. 6.

FIG. 7 is a transparent plan view of the print head 50 shown in FIG. 6. FIG. 7 primarily depicts the configuration of the wiring layers 120 and 122 and omits other members such as the wiring layer 74 of the wiring substrate 72 in order to make the configuration of the wiring layers 120 and 122 of the protective cover 68 easier to understand.

As shown in FIG. 7, electrodes 120*a* (indicated by the solid lines in FIG. 7) which electrically connect the lead electrodes 116 provided for the pressure chambers 52 with the connector 80 are formed on the wiring layer 120. Similarly, electrodes 122*a* (indicated by the dashed lines in FIG. 7) which electrically connect the lead electrodes 118 provided for the pressure chambers 52 with the connector 80 are formed on the wiring layer 122. The depiction in FIG. 7 is designed so that the electrodes 120*a* and 122*a* pass between the rows of pressure chambers without overlapping the pressure chambers 52 (or the piezoelectric elements 58), but in practice, the electrodes may be disposed so as to overlap the pressure chambers 52 (or the piezoelectric elements 58) because they are formed on different layers, as shown in FIG. 6.

According to this configuration, detection signals indicating the pressure fluctuations in the pressure chambers 52 are sent from the pressure sensors 130 to the pressure detection circuit (not shown) through the sensor electrodes 112 and 114, the lead electrodes 116 and 118, the wiring layers 120 and 122 of the protective cover 68, and the flexible cable 102. The pressure detection circuit determines whether the pressure fluctuations of the pressure chambers 52 are at a normal level.

When drive signals for the piezoelectric elements 58 are sent from the drive circuit (not shown) to the individual electrodes 57 of the piezoelectric elements 58 through the flexible cable 100, the wiring layer 74 of the wiring substrate 72, and the electrodes 92 of the wiring member 90, then the piezoelectric elements 58 deform, the portions of the diaphragm 56 corresponding to the pressure chambers 52 change their shape, and the ink filled in the pressure chambers 52 is pressurized and ejected as ink droplets from the nozzles 51.

In the present embodiment, all the individual electrodes 57 (driving electrodes) of the piezoelectric elements 58 are electrically connected to the flexible cable 100 through the wiring layer 74 (the second wiring layer) of the wiring substrate 72, while all the sensor electrodes 112 and 114 (detecting electrodes) of the pressure sensors 130 are electrically connected to the flexible cable 102 through the wiring layers 120 and 122 (the first wiring layers) of the protective cover 68. High density wiring can be mounted and mutual noise interference can be prevented by electrically connecting the individual electrodes 57 of the piezoelectric elements 58 and the sensor electrodes 112 and 114 of the pressure sensors 130 to the external wirings through different wiring layers.

In the present embodiment, the sensor electrodes 112 and 114 of the pressure sensors 130 are electrically connected to the wiring layers 120 and 122 of the protective cover 68, and the individual electrodes 57 of the piezoelectric elements 58 are electrically connected to the wiring layer 74 of the wiring substrate 72 through the electrodes 92 of the wiring member 90, but the present invention is not limited to this configuration, and another embodiment of an acceptable configuration is one wherein the sensor electrodes 112 and 114 of the pressure sensors 130 are electrically connected to the wiring layer 74 of the wiring substrate 72 through the electrodes 92 of the wiring member 90, and the individual electrodes 57 of the piezoelectric elements 58 are electrically connected to the wiring layer 120 (or 122) of the protective cover 68.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of ejection ports which eject liquid;

a plurality of pressure chambers which are communicated with the ejection ports;

a plurality of piezoelectric elements which are arranged to sides of the pressure chambers opposite sides of the pressure chambers where the ejection ports are formed, the piezoelectric elements each having driving electrodes, the piezoelectric elements each deforming the pressure chambers when drive signals are applied through the driving electrodes;

a protective member which covers the piezoelectric elements and has a first wiring layer electrically connected to a first external wiring;

a common liquid chamber which is arranged on the protective member on the sides of the plurality of pressure chambers opposite the sides of the pressure chambers where the ejection ports are formed, a wall of the common liquid chamber opposite the protective member having a second wiring layer electrically connected to a second external wiring, the common liquid chamber supplying the liquid to the plurality of pressure chambers; and a plurality of wiring members which are electrically connected to the second wiring layer and formed so that at least a part of each of the wiring members extends inside the common liquid chamber in a direction substantially perpendicular to a surface on which the piezoelectric elements are arranged, wherein a part of the driving electrodes of the piezoelectric elements are electrically connected to the first wiring layer, and another part of the driving electrodes of the piezoelectric elements are electrically connected to the second wiring layer through the wiring members.

2. The liquid ejection head as defined in claim 1, wherein the protective member is configured by overlapping a multilayer wired green sheet and a green sheet having recesses for covering the piezoelectric elements.

3. The liquid ejection head as defined in claim 1, wherein the protective member is configured by overlapping a wiring layer and an insulating layer on a silicon substrate, and has recesses for covering the piezoelectric elements formed on a side of the silicon substrate opposite the wiring layer.

4. The liquid ejection head as defined in claim 1, wherein the protective member is configured by overlapping an insulating layer and a wiring layer formed by a selective droplet ejection device on a rigid substrate, and has recesses for covering the piezoelectric elements formed on a side of the rigid substrate opposite the wiring layer.

5. The liquid ejection head as defined in claim 1, wherein a thickness from the side of the pressure chamber on the piezoelectric element to the side of the protective member on the common liquid chamber is not less than 100 μm and not more than 200 μm.

6. The liquid ejection head as defined in claim 1, further comprising:

a plurality of pressure sensors which detect pressure fluctuations in the pressure chambers, wherein all the driving electrodes of the piezoelectric elements are electrically connected to one of the first wiring layer and the second wiring layer, and all the detecting electrodes of the pressure sensors are electrically connected to the other of the first wiring layer and the second wiring layer.

7. The liquid ejection head as defined in claim 1, wherein the wiring members are formed so as to extend from the piezoelectric elements.

8. The liquid ejection head as defined in claim 1, wherein the wiring members are formed so as to extend from vicinity of the piezoelectric elements.

9. The liquid ejection head as defined in claim 1, wherein:

the ejection ports are two-dimensionally arrayed; and the wiring members are two-dimensionally arrayed with respect to the surface on which the piezoelectric elements are arranged.

10. An image forming apparatus, comprising the liquid ejection head as defined in claim 1.

* * * * *